US007789631B2

(12) United States Patent
Hoeger

(10) Patent No.: US 7,789,631 B2
(45) Date of Patent: Sep. 7, 2010

(54) COMPRESSOR OF A GAS TURBINE AND GAS TURBINE

(75) Inventor: Martin Hoeger, Erding (DE)

(73) Assignee: MTU Aero Engines GmbH, Munich (DE)

( * ) Notice: Subject to any disclaimer, the term of this patent is extended or adjusted under 35 U.S.C. 154(b) by 761 days.

(21) Appl. No.: 10/591,996

(22) PCT Filed: Mar. 3, 2005

(86) PCT No.: PCT/DE2005/000357

§ 371 (c)(1),
(2), (4) Date: Jun. 7, 2007

(87) PCT Pub. No.: WO2005/088135

PCT Pub. Date: Sep. 22, 2005

(65) Prior Publication Data

US 2007/0297904 A1 Dec. 27, 2007

(30) Foreign Application Priority Data

Mar. 10, 2004 (DE) ..... 10 2004 011 607

(51) Int. Cl.
*F01D 5/14* (2006.01)

(52) U.S. Cl. ..... 416/228; 416/238

(58) Field of Classification Search ..... 416/228, 416/238, 242

See application file for complete search history.

(56) References Cited

U.S. PATENT DOCUMENTS

| | | | | |
|---|---|---|---|---|
| 2,738,950 A | | 3/1956 | Price | 253/39.15 |
| 5,167,489 A | | 12/1992 | Wadia et al. | 415/182.1 |
| 6,071,077 A | * | 6/2000 | Rowlands | 416/223 A |
| 6,328,533 B1 | * | 12/2001 | Decker et al. | 416/228 |
| 6,341,942 B1 | * | 1/2002 | Chou et al. | 416/228 |
| 7,108,486 B2 | * | 9/2006 | Talbotec et al. | 416/243 |

FOREIGN PATENT DOCUMENTS

| | | |
|---|---|---|
| DE | 19 03 642 | 8/1970 |
| EP | 0 774 567 | 5/1997 |
| EP | 1 111 188 | 6/2001 |

* cited by examiner

*Primary Examiner*—Ninh H Nguyen
(74) *Attorney, Agent, or Firm*—Davidson, Davidson & Kappel, LLC

(57) ABSTRACT

A compressor, particularly a high-pressure compressor, of a gas turbine, particularly of an aircraft engine, includes at least one rotor and a number of blades (11, 12), which are assigned to the or to each rotor and which rotate together with the respective rotor. Each blade (11, 12) is delimited, in essence, by a flow entry edge or leading edge (16), a flow exit edge or trailing edge (17), and by a blade surface (20), which extends between the leading edge (16) and the trailing edge (17) while forming a suction side (18) and a pressure side. The leading edges (16) of the blades (11, 12) are slanted at a sweep angle that changes with the height of the respective blade (11, 12) in such a manner that the leading edges (16) comprise, in a radially external area (23) of the same, at least one forward sweep angle, a backward sweep angle or zero-sweep angle following in a radially external manner, and a forward sweep angle following, in a radially external manner, the backward sweep angle or the zero-sweep angle.

13 Claims, 2 Drawing Sheets

COMPRESSOR OF A GAS TURBINE AND GAS TURBINE

The present invention relates to a compressor of a gas turbine, in particular of an aircraft engine, comprising at least one rotor and multiple rotating blades which are assigned to the or each rotor and rotate together with the respective rotor, each rotating blade being essentially delimited by a flow inlet edge or leading edge, a flow outlet edge or trailing edge and a blade surface extending between the leading edge and the trailing edge and forming a suction side and a pressure side. Furthermore, the present invention relates to a gas turbine, in particular an aircraft engine, having at least one compressor, in particular a high-pressure compressor, comprising at least one rotor and multiple rotating blades which are assigned to the or each rotor and rotate together with the respective rotor, each rotating blade being essentially delimited by a flow inlet edge or leading edge, a flow outlet edge or trailing edge and a blade surface extending between the leading edge and the trailing edge and forming a suction side and a pressure side

BACKGROUND

Gas turbines, such as aircraft engines for example, are made up of multiple subassemblies, namely a fan, preferably multiple compressors, a combustion chamber, and preferably multiple turbines. For improving the efficiency and the working range of such gas turbines it is necessary to optimize all subsystems or components of the gas turbine. The present invention relates to the improvement of the efficiency and the working range of compressors, in particular transonic high-pressure compressors.

As a rule, compressors of gas turbines are made up of multiple stages, which are situated axially consecutively in the flow, each stage being formed by a rotating blade row formed by rotating blades assigned to a rotor. The rotating blades forming the rotating blade row and assigned to the rotor rotate together with the rotor vis-á-vis the stationary guide blades and a likewise stationary housing. For reducing manufacturing costs, an increasingly compact compressor design having the lowest possible number of stages is aimed for. Furthermore, the overall pressure conditions within the gas pressure turbine or the compressor and thus the pressure ratios between the individual stages increase due to the constant optimization of the efficiency and the working range of such compressors.

Increasingly larger stage pressure ratios and an increasingly smaller number of stages inevitably result in higher circumferential velocities of the rotating components of the compressor. The rotational speeds, which increase with the reduction of the number of stages, result in increasing mechanical stresses in particular on the rotating blades rotating together with the rotor and in a supersonic flow over the rotating blades as well as in transonic flow conditions within the blade grid.

Such flow conditions require an optimized, aerodynamic design of a compressor; in such an aerodynamic design, attention must be paid in particular to accurate contouring of the blade profiles and the leading edge of the blade.

For influencing the stability behavior of a fan and thus for optimizing the efficiency and the working range of same it is known from the related art to slant the fan blades of a fan in the area of its leading edge in the sense of a sweep angle. A distinction is made between fan blades whose leading edges are slanted in the sense of a forward sweep and such rotating blades whose leading edges are slanted in the sense of a backward sweep. Reference is made in this regard to U.S. Pat. No. 5,167,489.

SUMMARY OF THE INVENTION

An object of the present invention is to create a novel compressor of a gas turbine as well as a novel gas turbine.

The present invention provides a compressor. According to the present invention, the leading edges of the rotating blades are slanted at a sweep angle, which changes with the height of the respective rotating blade, in such a way that the leading edges have at least a forward sweep angle in a radially external area of the rotating blades, a backward sweep angle or zero sweep angle radially adjacent to the forward sweep angle on the outside, and a forward sweep angle radially adjacent to the backward sweep angle or the zero sweep angle on the outside.

In terms of the present invention, the efficiency and the working range of the compressor are optimized by the design of the leading edge of the rotating blades according to the present invention. The design of the leading edge of the rotating blades according to the present invention results in an aerodynamically optimal position of a shock wave or shock front of the compressor with regard to the leading edge of the rotating blade exposed to the flow. It has been recognized according to the present invention that the position of the shock front or shock wave of the compressor with regard to the leading edge of the rotating blades is important for providing optimum efficiency and an optimum working range of the compressor. The sweeps of the leading edges of fan blades known from the related art only affect the position of a shock front or shock wave on one suction side of the fan blades. It is thus recognized according to the present invention that, due to the design of the leading edges of the compressor rotating blades according to the present invention, an optimized position of the shock front with regard to the leading edge may be achieved due to the fact that the shock front is applied to the leading edge in the radially external area.

According to an advantageous refinement of the present invention, the radially external area of the leading edges, in which they have at least a forward sweep angle in a radially external area of the rotating blades, a backward sweep angle or zero sweep angle radially adjacent to the forward sweep angle on the outside, and a forward sweep angle radially adjacent to the backward sweep angle or the zero sweep angle on the outside, is between 60% and 100%, preferably between 70% and 100% of the height of the rotating blades.

According to another advantageous refinement of the present invention, the leading edges of the rotating blades have a forward sweep angle, a backward sweep angle adjacent to the forward sweep angle, and a forward sweep angle adjacent to the backward sweep angle in the radially external area in the direction from radially inside to radially outside. In the radially external area between 60% and 100%, preferably between 70% and 100%, of the height of the rotating blade, two forward-swept sections thus enclose one backward-swept section.

A gas turbine is also provided.

BRIEF DESCRIPTION OF THE DRAWINGS

Exemplary embodiments of the present invention are explained in greater detail on the basis of the drawing without being limited thereto.

Figure 2:
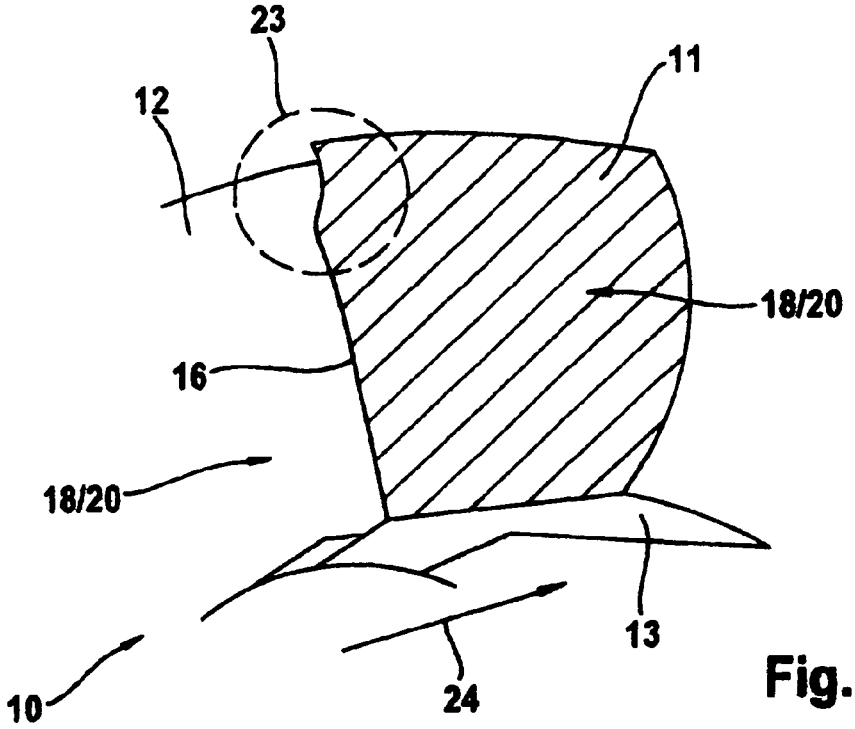
FIG. 2 shows a schematized section of the compressor according to the present invention in a view perpendicular to the suction side of a rotating blade of the compressor.
Figure 3:
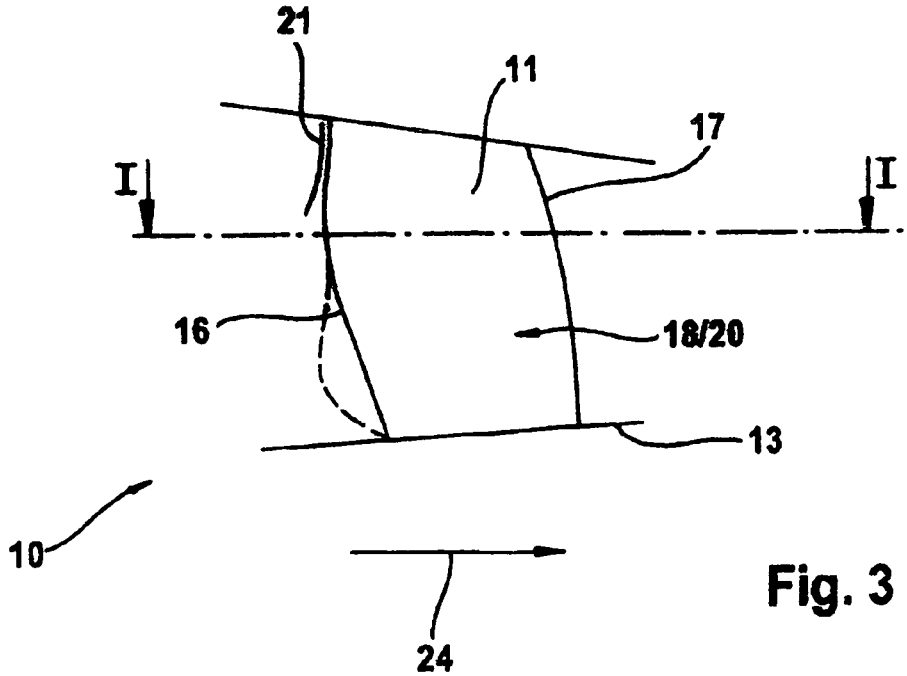
FIG. 3 shows a schematized section of the compressor according to the present invention in a meridional plane view of the compressor together with the position of a compressing shock close to the leading edge of the rotating blade.

The present invention is explained in greater detail in the following with reference to FIGS. 1 through 3.

DETAILED DESCRIPTION

Figure 1:
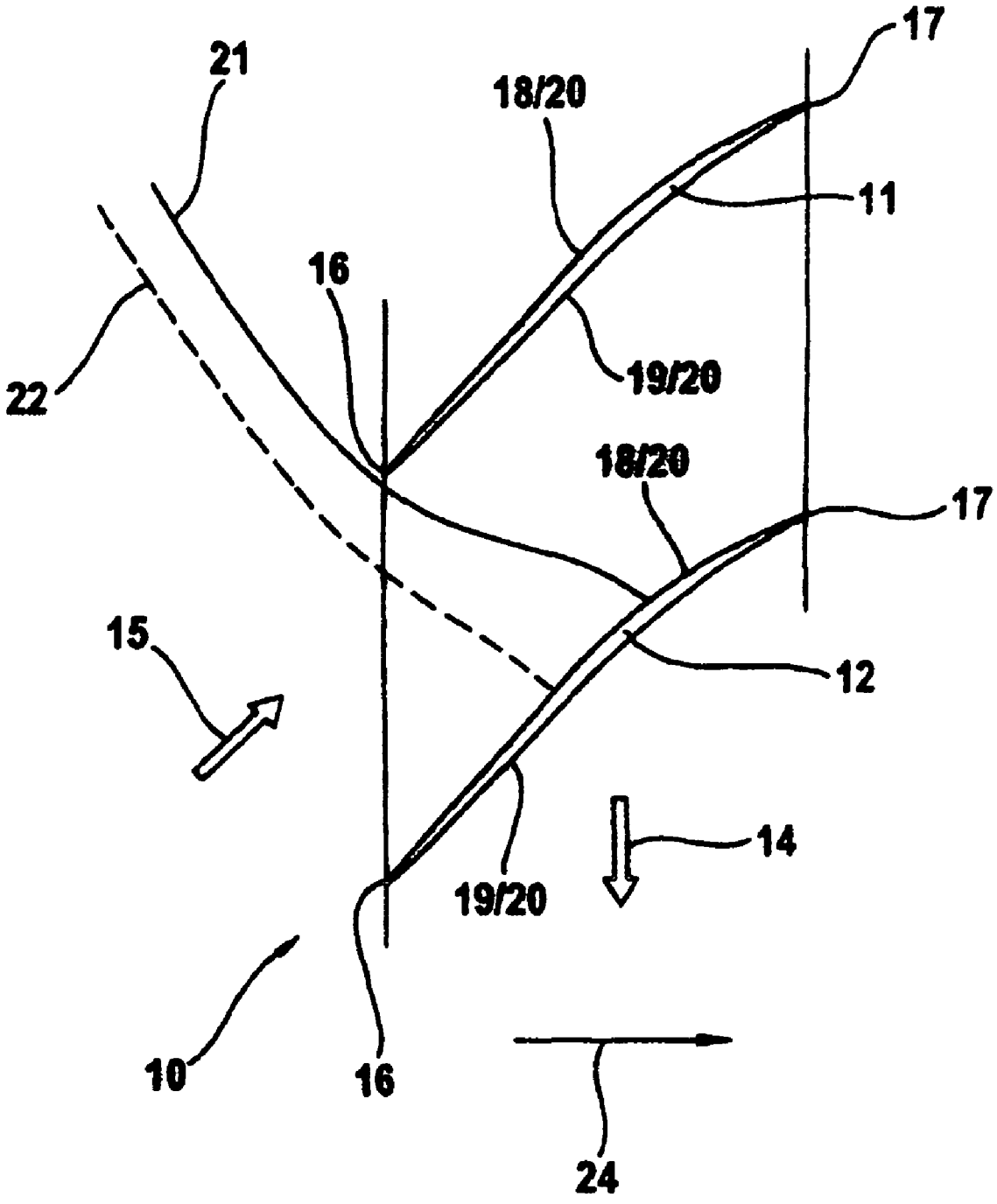
FIG. 1 shows a schematized section of a compressor according to the present invention in a view from radially outside onto two rotating blade profiles of the compressor according to the present invention, both rotating blade profiles being shown in cross section along section line I-I according to FIG. 3 running at approximately 80% of the blade height.

FIG. 1 shows a section of a compressor 10 according to the present invention in the area of two rotating blades 11 and 12 in a view from radially outside. In addition to rotating blades 11 and 12, a rotor hub 13 of compressor 10 is also apparent in FIG. 2. Rotating blades 11 and 12 rotate together with the rotor along the direction indicated by arrow 14. An arrow 15 indicates the flow-through direction or flow-in direction of the rotating blade grid of compressor 10 formed by rotating blades 11 and 12. The flow onto the rotating blade grid or rotating blades 11 and 12 is preferably in the supersonic range, while the flow from rotating blades 11 and 12 is in the subsonic range.

Each of rotating blades 11 and 12 of the rotating blade grid is essentially delimited by a flow inlet edge or leading edge 16, a flow outlet edge or trailing edge 17, and a blade surface 20 formed by a suction side 18 and a pressure side 19 between leading edge 16 and trailing edge 17. As mentioned above, the flow onto rotating blades 11 and 12 in the area of leading edges 16 is preferably in the supersonic range, while the flow from the rotating blades in the area of trailing edges 17 is preferably in the subsonic range. In terms of the present invention, the leading edges 16 of rotating blades 11 and 12 are designed in such a way that a gas-dynamic compatibility of rotating blades 11 and 12 with a compressor shock is established. In the case of such a gas-dynamic compatibility of rotating blades 11, 12 with the compressor shock, a shock front of the compressor shock is applied to the area of leading edge 16 of rotating blade 11 exposed to the flow. FIGS. 1 and 3 show a shock front 21 which, in rotating blades designed according to the present invention, is applied to leading edge 16 of rotating blade 11 exposed to the flow, namely in a radially external area of leading edge 16. Such an application of shock front 21 to compressor blade 11 exposed to the flow is aerodynamically and gas-dynamically optimal. Reference numeral 22 in FIG. 1 indicates a shock front separated from leading edge 16 of rotating blade 11 exposed to the flow which occurs in compressors according to the related art whose rotating blades are not designed in terms of the present invention. A shock front of the compressor shock separated from leading edge 16 of rotating blade 11 exposed to the flow in such a way is avoided by using the present invention, thereby optimizing the efficiency and the working range of compressor 10.

In terms of the present invention, leading edges 16 of rotating blades 11, 12 are slanted at a sweep angle, which changes with the height of the rotating blades, in such a way that leading edges 16 have at least a forward sweep angle in a radially outside area of the rotating blades, a backward sweep angle or zero sweep angle radially adjacent to the forward sweep angle on the outside, and a forward sweep angle radially adjacent to the backward sweep angle or the zero sweep angle on the outside. This area is indicated with reference numeral 23 in FIG. 2 which shows a view perpendicular to suction side 18 of rotating blade 11. For the sake of clearer illustration, suction side 18 of rotating blade 11 is shown cross-hatched in FIG. 2, whereas suction side 18 of rotating blade 12 positioned behind it is partly masked by rotating blade 11 and is shown without cross-hatching.

Radially external area 23 of leading edges 16 of the rotating blades, in which they have at least the forward sweep angle, the backward sweep angle or zero sweep angle radially adjacent to the forward sweep angle on the outside, and the forward sweep angle radially adjacent to the backward sweep angle or zero sweep angle on the outside, is between 60% and 100% of the radial height of rotating blades 11, 12. This area is preferably between 70% and 100% of the radial height of rotating blades 11, 12. The contouring of leading edges 16 of rotating blades 11, 12 according to the present invention thus affects the area of the blade tips of rotating blades 11, 12, i.e., the last 40% or 30% of rotating blades 11, 12 starting from hub area 13.

According to an advantageous refinement of the present invention, leading edges 16 of rotating blades 11, 12 have, in this radially external area 23 viewed from radially inside to radially outside, first a forward sweep angle, then a backward sweep angle adjacent to the forward sweep angle, and then again a forward sweep angle adjacent to the backward sweep angle. A design of the rotating blades is thus preferred in which they have two sections with forward sweep angles within radially external area 23, a section having one backward sweep angle being positioned between these two sections having forward sweep angles.

Within the present invention, the terms forward sweep angle and backward sweep angle should be defined in such a way that a rotating blade 11, 12 has a forward sweep angle on a leading edge 16 at a certain height when one point on leading edge 16 of a rotating blade section is positioned upstream at this height vis-á-vis the leading edge points of the rotating blade sections adjacent on the hub side, adjacent radially below, or adjacent radially within. In contrast, there is a backward sweep angle when one point on leading edge 16 of the rotating blade section is positioned downstream at a certain height vis-á-vis the leading edge points of the rotating blade sections adjacent on the hub side, adjacent radially below, or adjacent radially within. In the case of a zero sweep angle, adjacent leading edge points are not aerodynamically offset from one another. The flow-through direction is indicated in FIGS. 1 and 3 by an arrow 24. The sweep angle refers to the actual direction of flow onto the rotating blade.

In a preferred exemplary embodiment of the present invention, leading edge 16 of rotating blades 11, 12 has a forward sweep angle at a height of approximately 60% to 80% of the radial height of rotating blade 11, 12. Particularly preferred is a design in which this forward sweep angle is situated at a height of approximately 75% of the radial height of rotating blade 11, 12. Adjacent to this forward sweep angle is an area having a backward sweep angle or zero sweep angle, leading edge 16 having this backward sweep angle or zero sweep angle at a height of approximately 80% to 90%, in particular at a radial height of approximately 85%. Adjacent to this backward sweep angle or zero sweep angle is in turn an area of leading edge 16 having a forward sweep angle preferably in an area at a radial height of approximately 90% to 100%. Such a design of rotating blades 11, 12 is gas-dynamically and aerodynamically particularly preferred and ensures that the shock wave of a compressor shock is applied to the rotating blade exposed to the flow, thereby positively affecting the efficiency and the working range of the compressor.

It should be pointed out that the forward sweep angle and the backward sweep angle have values preferably up to 20°. However, larger forward sweep angles and backward sweep angles are also possible within the terms of the present invention.

As is apparent in the above description of the present invention, the invention relates to contouring of the blade leading edge in radially external area 23 which, as mentioned above, is situated at between 50% and 100%, in particular between 60% and 100%, preferably between 70% and 100% of the height of the rotating blade.

The area of blade leading edge 16, which is situated between hub 13 and radially external area 23, may be contoured in any desired way. FIG. 3 schematically shows different contours of leading edge 16 in the area between hub 13 and radially external area 23 which is contoured according to the present invention. In this area between hub 13 and radially external area 23, FIG. 3 shows a backward sweep of leading edge 16 indicated by a dashed line and a forward sweep of leading edge 16 indicated by a solid line. It should be pointed out here that the contouring of leading edge 16 in the area between hub 13 and radially external area 23, contoured according to the present invention, may be freely selected. The contouring of trailing edge 17 may also be freely selected.

In terms of the present invention, a gas-dynamically and aerodynamically optimized blading of compressor rotors is provided, in particular the radially external blade tips of the rotating blades being designed to be gas-dynamically compatible in the area of the leading edges with regard to a compressor shock. The head wave of a compressor shock is applied to the leading edge of the rotating blade exposed to the flow. This is achieved in that the leading edge of the rotating blade has at least one hybrid sweep in a radially external area, this hybrid sweep being formed by at least one forward-swept section and one backward-swept section adjacent radially on the outside.

At least the following advantages are obtained: improved efficiency of the compressor is achieved; the compressor has an expanded operating range with good efficiency and thus a broader working range; the surge limit margin of the compressor is optimized; the vibrational behavior is improved due to the modified radial distribution of the chord length; an improved rubbing behavior of the rotating blades appears. As is apparent in FIGS. 1 and 3, the shock front is applied to the rotating blade, designed according to the present invention, in the radially external area, contoured according to the present invention, of the leading edge of the rotating blade exposed to the flow. Such an application of the shock front to the compressor blade exposed to the flow is aerodynamically and gas-dynamically optimal.

What is claimed is:

1. A compressor comprising:

at least one rotor; and a plurality of rotating blades assigned to the at least one rotor and rotating together with the rotor, each rotating blade being delimited by a flow inlet leading edge, a flow outlet trailing edge and a blade surface extending between the leading edge and the trailing edge and forming a suction side and a pressure side, the leading edges of the rotating blades being slanted at a sweep angle changing with a height of the respective rotating blade so that, in a radially external area, the leading edges include at least one first forward sweep angle, include one backward sweep angle or zero sweep angle radially adjacent to the first forward sweep angle outside of the first forward sweep angle, and one second forward sweep angle radially adjacent to the backward sweep angle or zero sweep angle on the outside, the radially external area of the leading edges being situated between 60% and 100% of the radial height of the rotating blade.

2. The compressor as recited in claim 1 wherein the radially external area is between 65% and 100% of the radial height of the rotating blade.

3. The compressor as recited in claim 1 wherein the radially external area of the leading edges is between 70% and 100% of the radial height of the rotating blade.

4. The compressor as recited in claim 1 wherein the leading edges include the backward sweep angle.

5. The compressor as recited in claim 1 wherein the leading edges have the first forward sweep angle at a height of approximately 60% to 80% of the radial height of the rotating blades.

6. The compressor as recited in claim 1 wherein the leading edges have the backward sweep angle or zero sweep angle at a height of approximately 80% to 90% of the radial height of the rotating blades.

7. The compressor as recited in claim 1 wherein the leading edges have the second forward sweep angle at a height of approximately 90% to 100% of the radial height of the rotating blades.

8. The compressor as recited in claim 1 wherein a first of the plurality of rotating blades has the second forward sweep angle at the leading edge at a certain radial height when one point of the leading edge of the rotating blade at the certain radial height is positioned upstream vis-à-vis leading edge points of further rotating blades adjacent on a hub side.

9. The compressor as recited in claim 1 wherein a first of the plurality of rotating blades has the second forward sweep angle at the leading edge at a certain radial height when one point of the leading edge of the rotating blade at the certain radial height is positioned downstream vis-à-vis the leading edge points of further rotating blades adjacent on a hub side.

10. The compressor as recited in claim 1 wherein the compressor is a high pressure compressor of a gas turbine.

11. The compressor as recited in claim 10 where in the gas turbine is an aircraft engine.

12. A gas turbine comprising at least one compressor as recited in claim 10.

13. An aircraft engine comprising at least one compressor as recited in claim 10.

* * * * *